US005285819A

United States Patent [19]

Froment et al.

[11] Patent Number: 5,285,819

[45] Date of Patent: Feb. 15, 1994

[54] DOBBY DRAWING DEVICE

[75] Inventors: Jean-Paul Froment, Doussard; André Fumex, Talloires; Jean-Pierre Pages, Faverges, all of France

[73] Assignee: S.A. des Etablissments Staubli (France), Faverges, France

[21] Appl. No.: 913,952

[22] Filed: Jul. 17, 1992

[30] Foreign Application Priority Data

Aug. 6, 1991 [FR] France ..... 91 10212

[51] Int. Cl.[5] ..... D03C 1/14

[52] U.S. Cl. ..... 139/84; 139/88; 139/89

[58] Field of Search ..... 139/84, 88, 89

[56] References Cited

U.S. PATENT DOCUMENTS 4,481,979 11/1984 Mizuguchi ..... 139/84
4,687,029 8/1987 Takada ..... 139/84
4,905,739 3/1990 Froment ..... 139/89

FOREIGN PATENT DOCUMENTS 325547 1/1989 European Pat. Off. .
85419 2/1895 Fed. Rep. of Germany .

*Primary Examiner*—Andrew M. Falik
*Attorney, Agent, or Firm*—Dowell & Dowell

[57] ABSTRACT

In a dobby drawing device in a weaving loom, the vertical displacement of a heddle frame is obtained with the aid of a single cable which is guided over first and second actuating levers to a set of springs. Two support shafts selectively support the actuating levers so the device may have a lifting or descending action.

4 Claims, 3 Drawing Sheets

DOBBY DRAWING DEVICE

BACKGROUND OF THE INVENTION

1. Field of the Invention

The present invention relates to dobbies and other weaving mechanisms of the negative type and more particularly to the drawing device interposed between each of the rocking members for maneuvering such mechanisms and the heddle frames of the weaving machine.

2. History of the Related Art

In the known art and as shown in FIG. 1 of the drawings, each drawing device flexible connections includes two cables a and b which are fastened by their substantially parallel ends to the same rocking member c of the dobby which is fixed to the superstructure e which surmounts the set of heddle frames f of the weaving machine. Each of the cables a and b is positioned and guided by an idle pulley g wound over the sectioned periphery of an actuating lever h connected to an upper crosspiece of the frame f by an articulated rod i; Each cable is fixed to it's lever h at a point j and extends therebeyond to its free end which is secured to a set of springs k common to the two cables a and b.

Experience has shown that this conventional structure presents two major drawbacks:

Firstly, the fastening of the two cables on member c necessarily involves using spliced loops or endpieces which are always difficult to fix on the member in view of the small spacing between the different members of the dobby. Replacement of a worn or cut cable is thus particularly delicate.

Secondly, for the same reason of space, guide pulleys g of small diameter must be used, which are the cause of breakdown of the cables due to the fatigue generated due to the alternate flexations thereof. In addition, this arrangement is cumbersome and expensive.

It is an object of the present invention to overcome these drawbacks.

SUMMARY OF THE INVENTION

The present invention relates to a drawing device for controlling the heddle frames of weaving mechanisms of the negative type which include flexible connections of which one end is coupled to one of the rocking members while the opposite end is fastened to a set of return springs after having been fastened and guided over a sectioned periphery of two actuating levers connected to a heddle frame, and wherein a single flexible connecting element is coupled to each rocking member and is fastened and passes over a first actuation lever, being directly fastened and passes over a second actuation lever which guides the connecting element set of springs.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
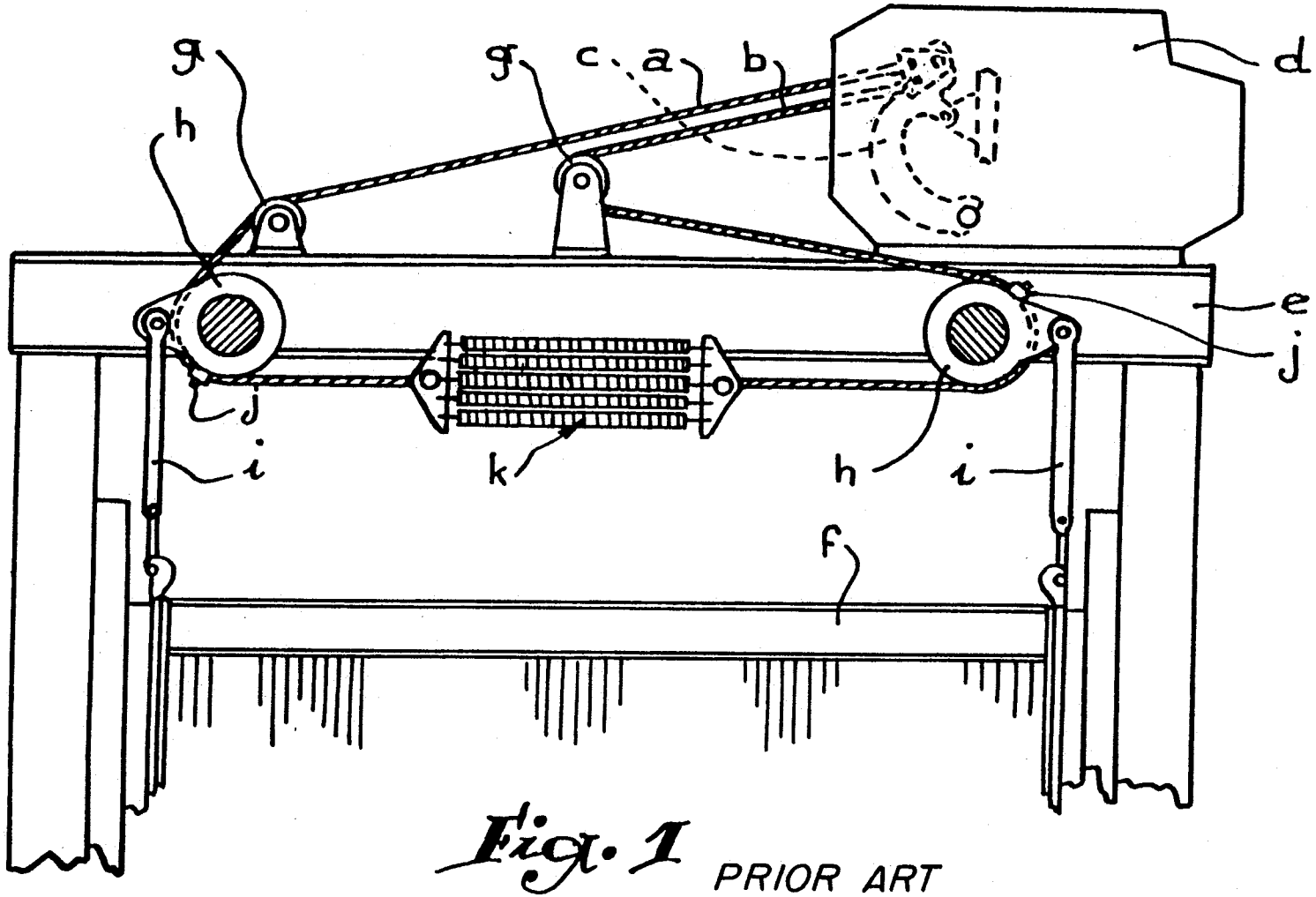
Fig. 1 PRIOR ART
FIG. 1, as indicated hereinabove, illustrates the usual arrangement of a conventional drawing device.
Figure 2:
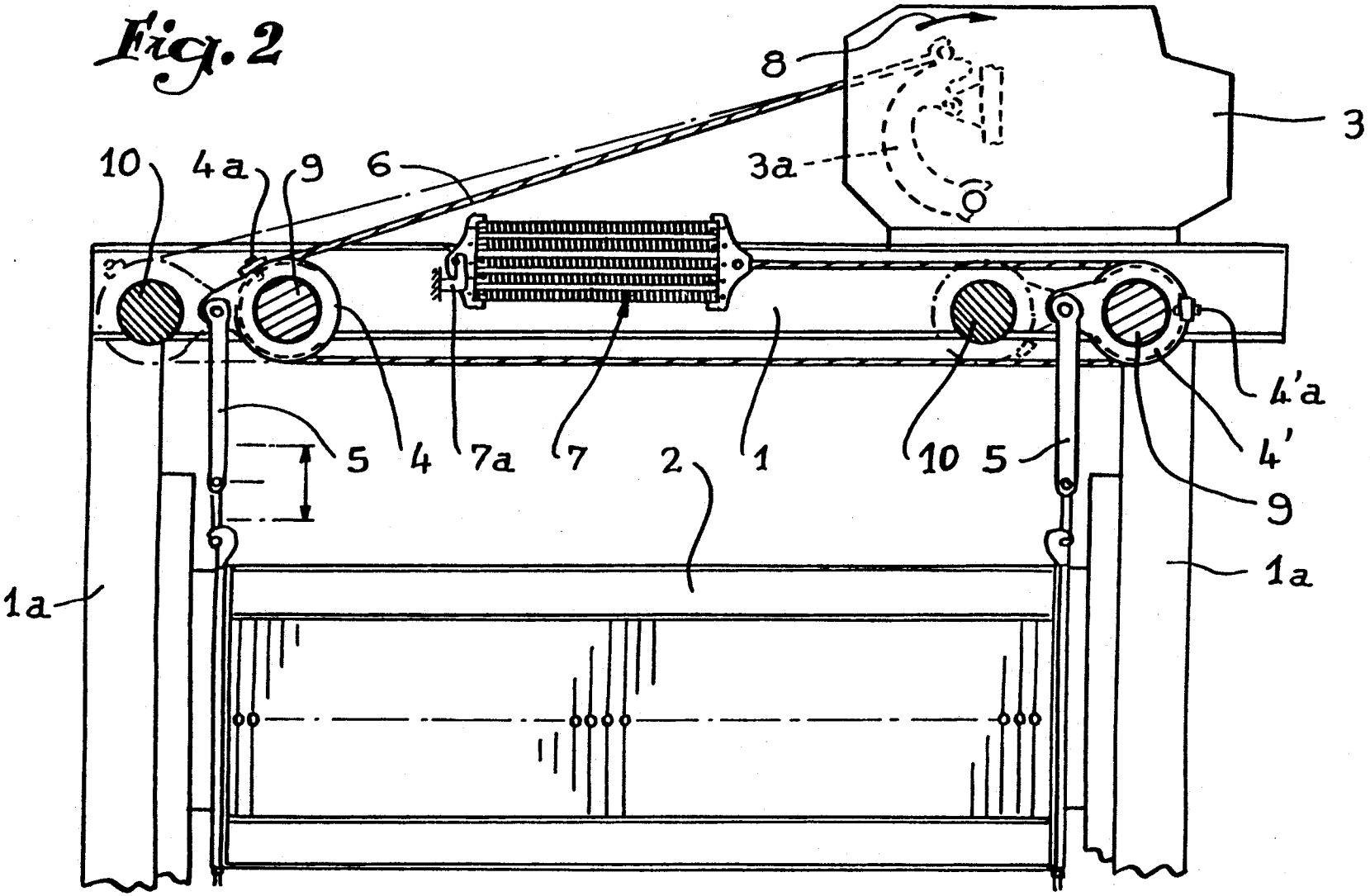
FIG. 2 shows the structure of a drawing device according to the present invention.

Referring again to the drawings, FIG. 2 shows a superstructure 1 which supports the heddle frames 2 of a dobby 3. Each of the rocking members 3*a* for maneuvering the dobby being connected to the corresponding needle frame 2 by a drawing device which employs first and second levers 4 and 4' and two articulated rods 5.

According to the invention, the drawing device includes a single cable 6 of which one end is fastened to the rocking member 3*a* and which is directly wound on the first lever 4, without any intermediate guide pulley. This single cable 6 is secured at 4*a* to lever 4 which guides it horizontally towards the second lever 4' on which it is wound and to which it is also secured at 4'*a*. This second lever 4' horizontally guides the end of the cable towards a set of springs 7 to which it is fastened. The set of springs 7 is fastened at 7*a* to the superstructure 1.

It will be readily appreciated that, when the rocking member 3*a* moves angularly in the direction of arrow 8, the traction exerted on cable 6 causes the lever 4 to pivot in a dextrorse direction, lever 4' in a sinistrorse direction, against the reaction of the set 7 of springs which are stretched. The two rods 5 are consequently displaced upwardly, which lifts frame 2. When member 3*a* is moved in the opposite direction, the set of springs 7 returns the frame 2 to the lower position.

It goes without saying that because there is only one cable 6 considerably facilitates fastening to the member 3*a* which controls it; a cable of large section may thus be used which may move at high rates without risk of breaking. Cable 6 is wound over large diameter levers 4 and 4', which substantially reduces fatigue.

It will be noted that, in FIG. 2, the drawing device has a lifting action since the frame 2 is positively drawn upwardly by the rods 5. In accordance with a particularly advantageous embodiment of the invention, the superstructure 1 may be provided with two parallel support shafts 9 and 10 for each series of levers 4 or 4'. Under these conditions, by dismantling the set of springs 7 and the rods 5, levers 4 and 4' are passed from shafts 9 to shafts 10 to obtain drawing devices working downwardly; the positive control of the frames 2 in such case being exerted downwardly. The same weaving machine may therefore be provided with frames with lifting action and frames with descending action, which provides particular advantages for obtaining certain weaves.

Figure 3:
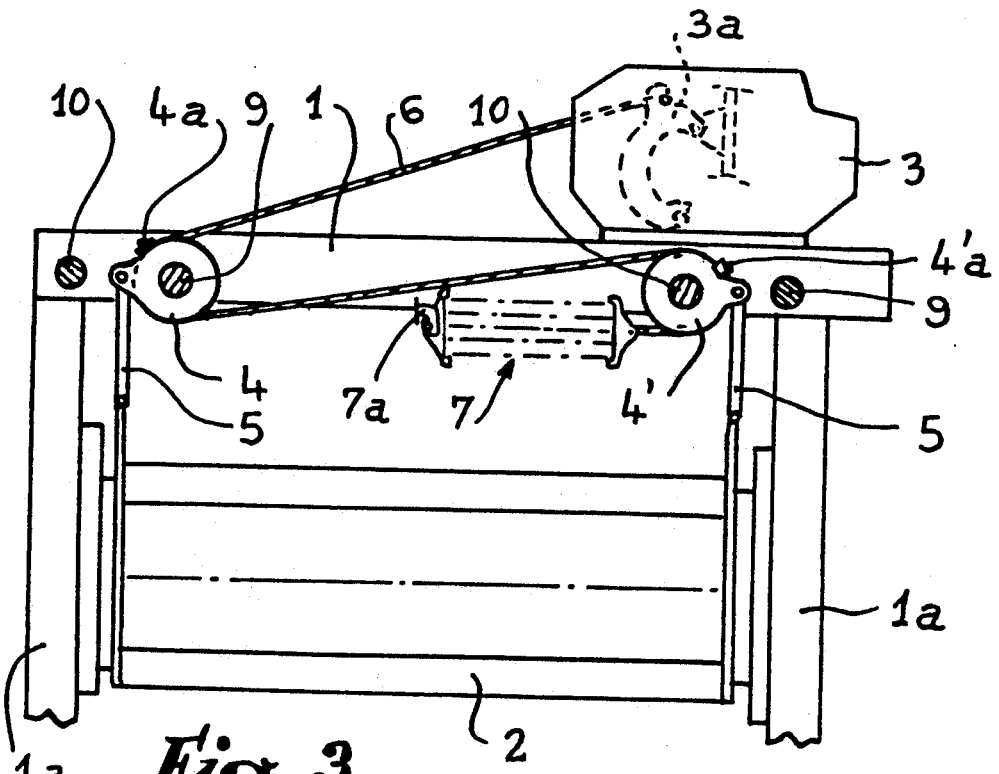
FIGS. 3 and 4 schematically show two alternate embodiments of the invention.

The invention may be the subject matter of different variations. As illustrated in FIG. 3, the strand of the cable 6 which extends between levers 4 and 4' may be oriented obliquely, which makes it possible to house the set of springs 7 below this strand.

Figure 4:
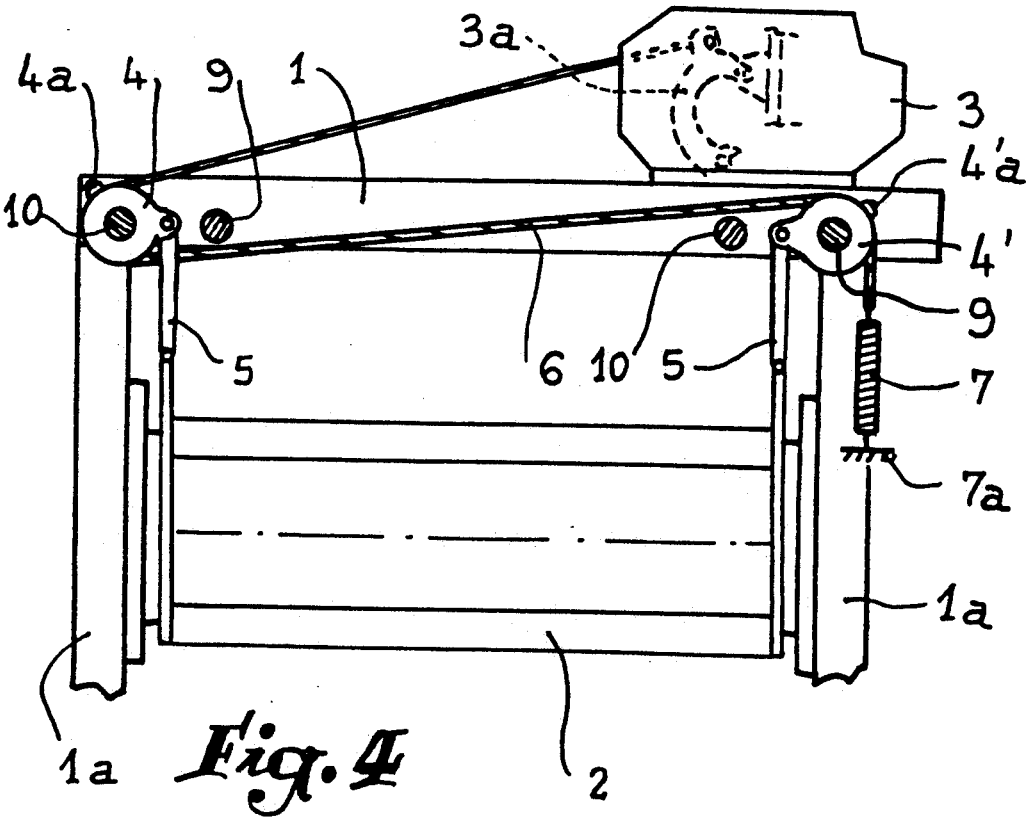

This same arrangement may be used for obtaining a drawing device with descending action, as illustrated in FIG. 4, where the set of springs 7 is vertical, being fastened to one of the two uprights 1*a* of the superstructure 1.

It will further be observed that the drawing device may be disposed below the heddle frames 2 and not above, as has been assumed in the foregoing description. Functioning remains identical and perfectly equivalent advantages are obtained.

What is claimed is:

1. In a weaving mechanism of the negative type which includes a drawing device for controlling the movement of a heddle frame, a rocking member for manipulating the heddle frame and a pair of spaced actuating levers which are connected to the heddle frame, and wherein the drawing device includes connection means coupled to the rocking members and extending over the spaced actuating levers and to a set of return springs, the improvement comprising, said connection means including a single flexible connecting element having a first end coupled to the rocking member, an intermediate portion which is passed over a first of the actuating levers and then over a second of the actuating levers which guide the single flexible connecting element to the set of return springs, and said flexible connecting element having a second end connected to the set of return springs.

2. The weaving mechanism of claim 1, including first and second shafts located thereon for selectively supporting each of said first and second actuating levers whereby by transferring the levers from one of said shafts to the other a lifting or descending movement of the heddle frame is obtained.

3. The weaving mechanism of claim 2, including means for securing said single flexible connecting means to each of said first and second actuating levers.

4. The weaving mechanism of claim 1, including means for securing said single flexible connecting means to each of said first and second actuating levers.

* * * * *